United States Patent [19]

Watanabe

[11] Patent Number: 4,685,794

[45] Date of Patent: Aug. 11, 1987

[54] IMAGE FORMING APPARATUS

[75] Inventor: Junji Watanabe, Yokohama, Japan

[73] Assignee: Kabushiki Kaisha Toshiba, Kawasaki, Japan

[21] Appl. No.: 776,134

[22] Filed: Sep. 13, 1985

[30] Foreign Application Priority Data

Sep. 14, 1984 [JP] Japan ..... 59-193224

[51] Int. Cl.[4] ..... G03G 15/00

[52] U.S. Cl. ..... 355/7; 355/3 R; 355/14 E

[58] Field of Search ..... 355/3 R, 3 ER, 14 E, 355/4, 7, 67, 70

[56] References Cited

U.S. PATENT DOCUMENTS 3,848,989 11/1974 Yamaji et al. ..... 355/4
3,914,043 10/1975 McVeigh ..... 355/4
4,582,417 4/1986 Yagasaki et al. ..... 355/7

FOREIGN PATENT DOCUMENTS 56-158347 12/1981 Japan .
59-15948 1/1984 Japan .
59-77768 5/1984 Japan .
1017204 1/1966 United Kingdom .
1109131 4/1968 United Kingdom .
1282018 7/1972 United Kingdom .

*Primary Examiner*—A. C. Prescott
*Assistant Examiner*—Carl Romano
*Attorney, Agent, or Firm*—Schwartz, Jeffery, Schwaab, Mack, Blumenthal & Evans

[57] ABSTRACT

An image forming apparatus is provided with a light emitting element for indicating a specific range of an original disposed on an original table, and the other light emitting elements for erasing the electric charge on the surface of a photosensitive body in response to the specific range of the original indicated by the light emitting element. A spot light is applied to the original on the original table by the light emitting element, and moved to specify the perimeter of an erasure range. In image forming, the specific range inside the perimeter is defined by an erasure range designating key and is developed through the black toner by a developing device. On the other side, the specific range outside the perimeter is defined by the other erasure range designating key and is developed through the red toner by the other developing device.

9 Claims, 33 Drawing Figures

IMAGE FORMING APPARATUS

BACKGROUND OF THE INVENTION

The present invention relates to an image forming apparatus capable of executing at least two developing modes.

Generally capable of copying an image of the original on a reduced or enlarged scale, conventional electronic copying machines can enjoy only unicolor copying.

There has recently been a demand for the development of apparatuses which can copy a desired portion or portions of a unicolor original image in another color. With use of such apparatuses, for example, only the desired portion may be copied in red, leaving the remaining portion in black, or in the case of an original with photograph(s), characters and photograph(s) should be copied with sharp and soft textures, respectively. It would be difficult for the prior art electronic copying machines, however, to meet these requirements.

SUMMARY OF THE INVENTION

The present invention is contrived in consideration of these circumstances, and is intended to provide an image forming apparatus capable of designating desired portions of an image of the original so that the designated portions are developed in a different mode.

According to the present invention, for example, two developing units are used which store therein developing agents of different colors. These developing units can be alternatively operated to form a multicolor image on a single paper sheet. Also, any range of an original image can be erased as specified. Thus, any desired portions of the original image may be changed in color.

BRIEF DESCRIPTION OF THE DRAWINGS

FIGS. 1 to 24 show an embodiment of an image forming apparatus according to the present invention, in which:

FIG. 1 is a perspective view showing an outline of the apparatus;

FIG. 2 is a side sectional view showing the internal construction of the apparatus;

FIGS. 3 and 4 are side sectional views for illustrating multicolor and duplex copying operations, respectively;

FIG. 5 is a plan view of a control panel;

FIG. 6 is a perspective view showing an arrangement of drive sections;

FIG. 7 is a perspective view schematically showing a drive mechanism for an optical system;

FIG. 8 is a perspective view schematically showing a drive mechanism for indexes;

FIG. 9 is a perspective view schematically showing a drive mechanism for a delivery roller and a separating roller pair;

FIG. 11 is a block diagram showing a general control circuit;

FIG. 12 is a perspective view of an essential part including a spot light source;

FIG. 13 is a side sectional view of the essential part including the spot light source;

FIGS. 14, 15 and 16 are plan views illustrating an operation for specifying an erasure range of the original using the spot light source;

FIG. 18 is a side sectional view of an essential part showing an arrangement of an erasure array;

FIGS. 19 and 20 are a perspective view and a front view, respectively, of only the principal part of the erasure array, showing the relationship between the erasure array and a photosensitive drum;

FIG. 22 is a circuit diagram illustrating the configuration of an array drive section;

FIG. 24 is a side sectional view of an essential part showing another arrangement of the erasure array.

DETAILED DESCRIPTION OF THE PREFERRED EMBODIMENT

One embodiment of the present invention will now be described in detail with reference to the accompanying drawings.

Figure 1:
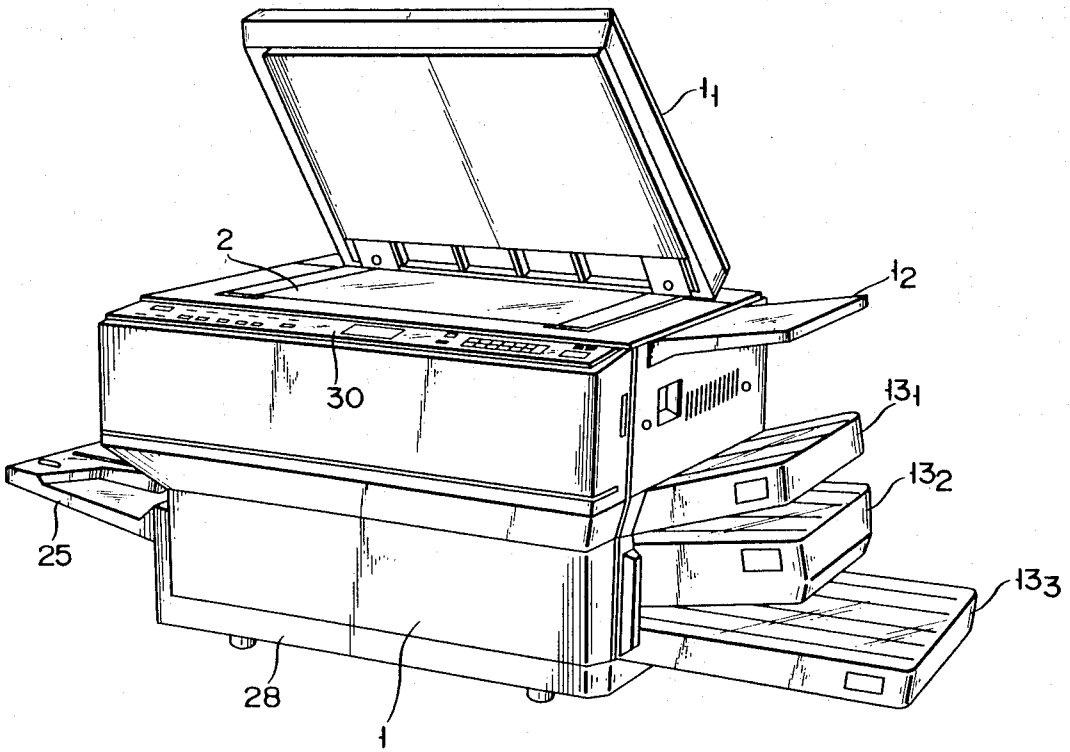
Figure 2:
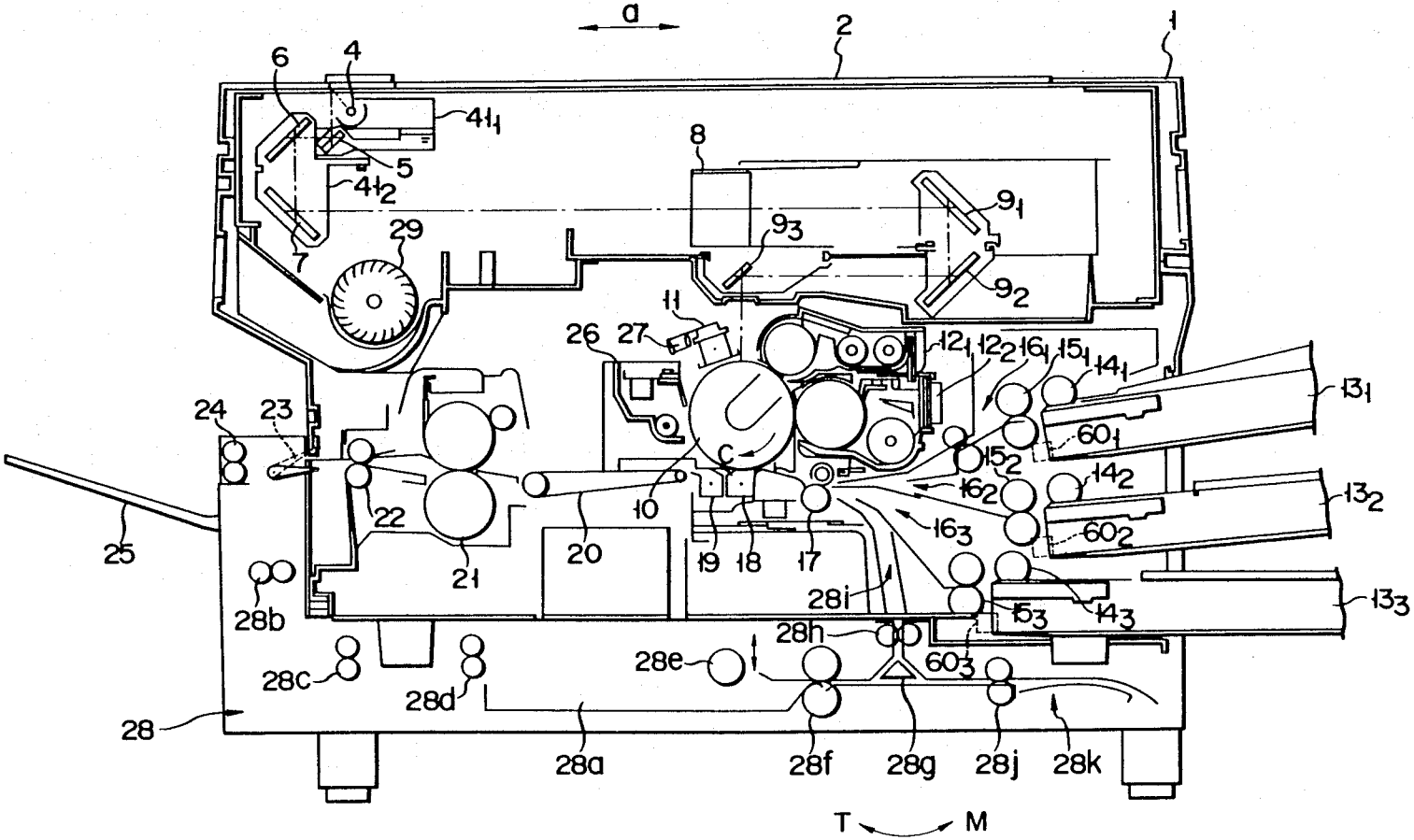

FIGS. 1 and 2 schematically show a copying machine as an image forming apparatus according to the embodiment of the invention. In FIGS. 1 and 2, numeral 1 designates a housing of the copying machine. An original table 2 (transparent glass) for carrying an original is fixed on the top of the housing 1. A swingable original cover $\mathbf{1}_1$ and a worktable $\mathbf{1}_2$ are arranged beside the original table 2. The original set on the original table 2 is scanned for image exposure as an optical system 3 including an exposure lamp 4 and mirrors 5, 6 and 7 reciprocates in the direction indicated by arrow a along the under surface of the original table 2. In this case, the mirrors 6 and 7 move at a speed half that of the mirror 5 so as to maintain a fixed optical path length.

A reflected light beam from the original scanned by the optical system 3, that is, irradiated by the exposure lamp 4, is reflected by the mirrors 5, 6 and 7, transmitted through a lens block 8 for magnification or reduction, and then reflected by mirrors $\mathbf{9}_1$, $\mathbf{9}_2$ and $\mathbf{9}_3$ to be projected on a photosensitive drum 10. Thus, an image of the original is formed on the surface of the photosensitive drum 10.

The photosensitive drum 10 rotates in the direction indicated by arrow c so that its surface is wholly charged first by a main charger 11. The image of the original is projected on the charged surface of the photosensitive drum 10 by slit exposure, forming an electrostatic latent image on the surface. The electrostatic latent image is developed into a visible image (toner image) by two developing units $\mathbf{12}_1$ and $\mathbf{12}_2$ which store therein, for example, red and black toners, individually, and are alternatively operated as required.

Paper sheets (image record media) P are delivered one by one from an upper paper cassette $\mathbf{13}_1$, a middle paper cassette $\mathbf{13}_2$, or a lower paper cassette $\mathbf{13}_3$ by a paper-supply roller $\mathbf{14}_1$, $\mathbf{14}_2$ or $\mathbf{14}_3$ and a roller pair $\mathbf{15}_1$, $\mathbf{15}_2$ or $\mathbf{15}_3$, and guided along a paper guide path $\mathbf{16}_1$, $\mathbf{16}_2$ or $\mathbf{16}_3$ to an aligning roller pair 17. Then, each paper sheet P is delivered to a transfer region by the aligning roller pair 17, timed to the formation of the visible image on the photosensitive drum 10.

The paper cassettes $13_1$, $13_2$ and $13_3$ are removably attached to the lower right end portion of the housing 1, and can be alternatively selected by the operation on a control panel which will be described in detail later. The paper cassettes $13_1$, $13_2$ and $13_3$ are provided respectively with cassette size detecting switches $60_1$, $60_2$ and $60_3$ which detect the selected cassette size. The detecting switches $60_1$, $60_2$ and $60_3$ are each formed of a plurality of microswitches which are turned on or off in response to the insertion of cassettes of different sizes.

The paper sheet P delivered to the transfer region comes into intimate contact with the surface of the photosensitive drum 10, in the space between a transfer charger 18 and the drum 10. As a result, the toner image on the photosensitive drum 10 is transferred to the paper sheet P by the agency of the charger 18. After the transfer, the paper sheet P is separated from the photosensitive drum 10 by a separation charger 19 and transported by a conveyor belt 20. Thus, the paper sheet P is delivered to a fixing roller pair 21 as a fixing unit arranged at the terminal end portion of the conveyor belt 20. After the fixation, the paper sheet P is discharged into a tray 25 outside the housing 1 by a delivery roller pair 22, a directing gate 23 in a position shown in full line in FIG. 2, and an exit roller pair 24.

After the transfer, moreover, the photosensitive drum 10 is de-electrified by a de-electrification charger 26, when the residual toner on the surface of the drum 10 is removed by a cleaner 26. Thereafter, a residual image on the photosensitive drum 10 is erased by a discharge lamp 27 to restore the initial state. In FIG. 2, numeral 29 designates a cooling fan for preventing the temperature inside the housing 1 from rising.

Meanwhile, the copying machine housing 1 is underlain by a duplex/multicolor copying unit 28 which is adapted for duplex copying on both sides of each paper sheet or multicolor copying on each paper sheet surface. The unit 28 includes the directing gate 23, the exit roller pair 24, and a plurality of roller pairs 28*b*, 28*c* and 28*d* for feeding the paper sheet redirected by the gate 23 into a collecting section 28*a*.

The collecting section 28*a* is provided with a delivery roller 28*e* for delivering the paper sheets temporarily stored in the collecting section 28*a*. The delivery roller 28*e* can move up and down as indicated by the arrow in accordance with the thickness of a pile of paper sheets (or the number of paper sheets in a pile) stored in the collecting section 28*a*. The paper sheets delivered by the delivery roller pair 28*e* are guided to a control gate 28*g* through a separating roller pair 28*f* for feeding the paper sheets separately, i.e., one by one.

In multicolor copying, the control gate 28*g* is rocked in the direction indicated by arrow M so that the paper sheet is guided to the aligning roller pair 17 through a feed roller pair 28*h* and a paper guide path 28*i*. In duplex copying, on the other hand, the control gate 28*g* is shifted to the position shown in FIG. 2 so that the paper sheet is guided to a reversal section 28*k* by a feed roller pair 28*j*. When the paper sheet reaches the reversal section 28*k*, the control gate 28*g* is rocked in the direction indicated by arrow T so that the paper sheet advanced by the feed roller pair 28*j* is guided to the aligning roller pair 17 through the feed roller pair 28*h* and the paper guide path 28*i*.

The duplex and multicolor copying operations of the apparatus with this construction will now be explained. The copying mode is selected by the key operation on the control panel.

Figure 3:
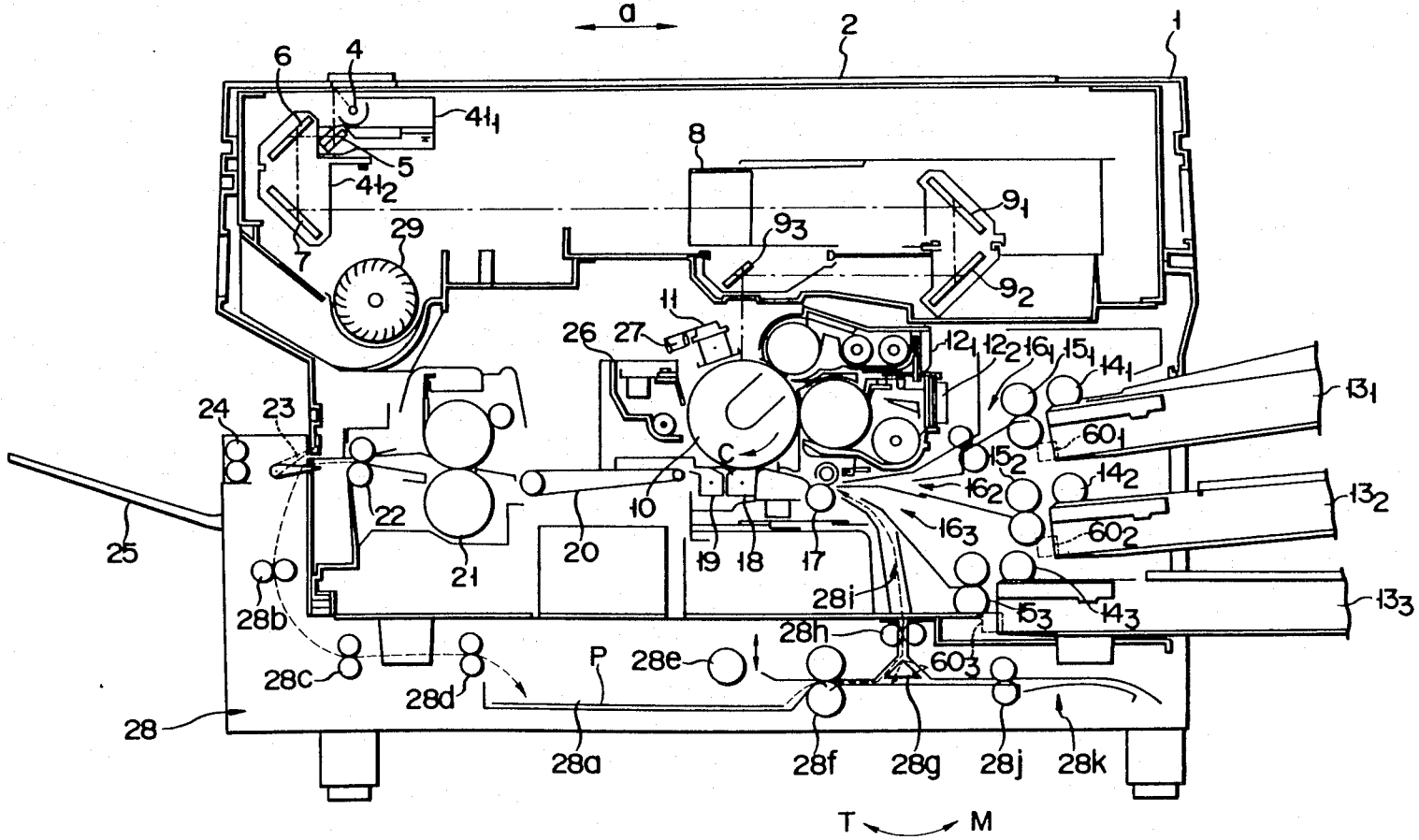

First, referring to FIG. 3, the multicolor copying mode will be described. A paper sheet having undergone regular one-side copying is guided into the duplex/multicolor copying unit 28 by the directing gate 23 shifted in the direction shown by the dotted line in FIG. 3. The paper sheet is guided to the collecting section 28*a* by the roller pairs 28*b*, 28*c* and 28*d*. At this time, the delivery roller 28*e* is located in its upper limit position, and the copied surface of the paper sheet faces downward. Thereafter, when another original is set on the original table 2 and a copy key (mentioned later) is depressed, the delivery roller 28*e* is lowered to engage the paper sheet, thereby delivering the same. Then, the paper sheet is guided to the aligning roller pair 17 by means of the separating roller pair 28*f*, the control gate 28*g* shifted in the direction shown by the dotted line in FIG. 3, the feed roller pair 28*h*, and the paper guide path 28*i*. Thus, copying from the second original can be performed.

At this time, the copied surface of the paper sheet faces the photosensitive drum 10, so that an image of the second original is copied onto the paper sheet, superposed on the previously copied image. After undergoing the multicolor or superpositive copying, the paper sheet is discharged into the tray 25 through the conveyor belt 20, the fixing roller pair 21, the delivery roller pair 22, the directing gate 23 in the position shown in full line in FIG. 3, and the exit roller pair 24.

Figure 4:
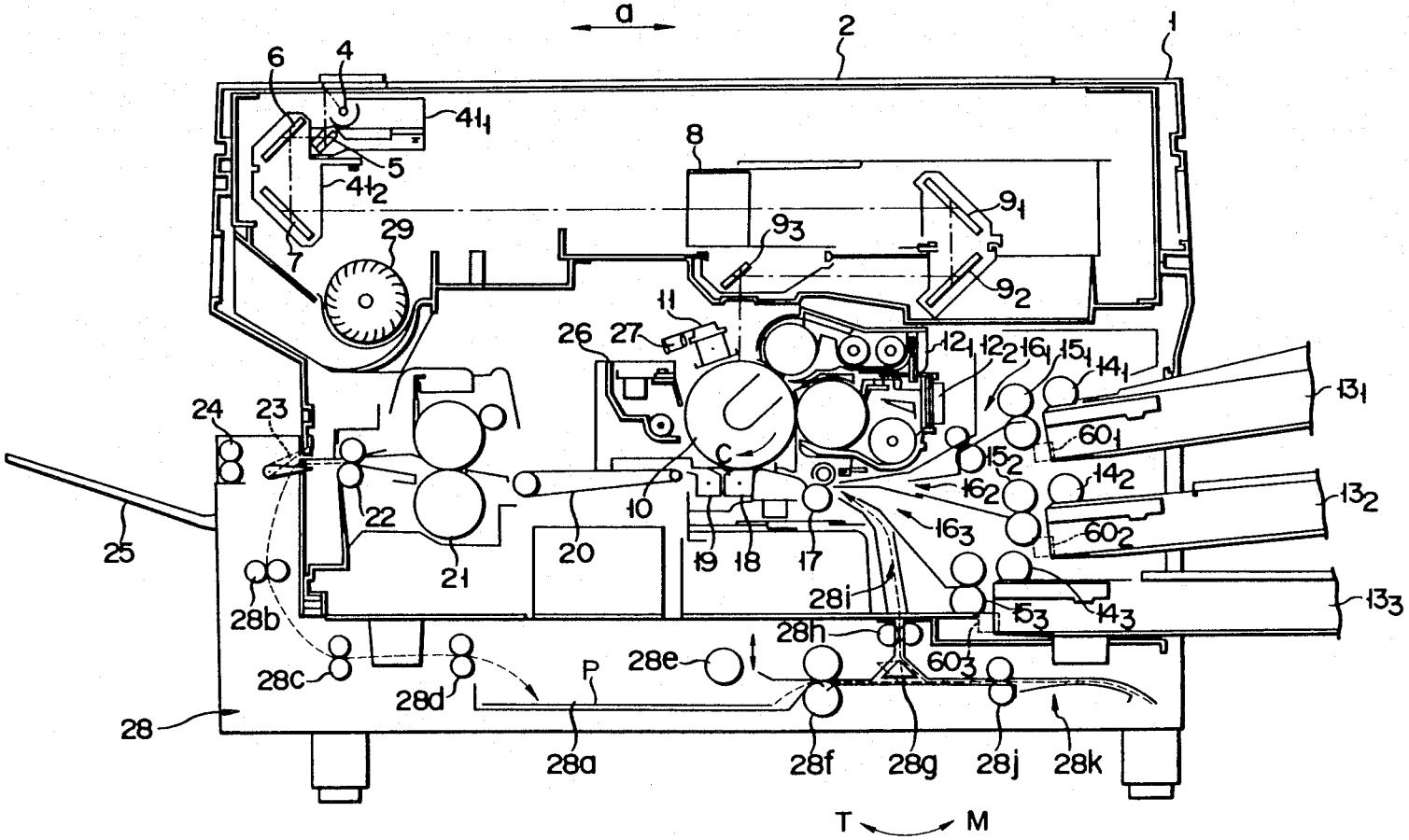

Referring now to FIG. 4, the duplex copying mode will be described. In this case, as in the case of the multicolor copying mode, a paper sheet having undergone regular one-side copying is delivered to the collecting section 28*a* of the duplex/multicolor copying unit 28. Thereafter, when another original is set on the original table 2 and the copy key is depressed, the paper sheet is delivered by the delivery roller 28*e*. Then, the paper sheet is guided to the reversal section 28*k* by means of the separating roller pair 28*f*, the control gate 28*g* in the position shown in full line, and the feed roller pair 28*j*. When the trailing end of the paper sheet passes through the control gate 28*g*, the control gate 28*g* is shifted to the position shown in the dotted line, and the feed roller pair 28*j* is reversed. Thus, the paper sheet is guided to the aligning roller pair 17 by means of the control gate 28*g*, the feed roller pair 28*h*, and the paper guide path 28*i*, to be subjected to copying from the second original. At this time, the other surface of the paper sheet opposite to the previously copied surface thereof faces the photosensitive drum 10, so that an image of the second original is copied onto the other surface. After the copying, the paper sheet is discharged into the tray 25 in the same manner as aforesaid.

Figure 5:
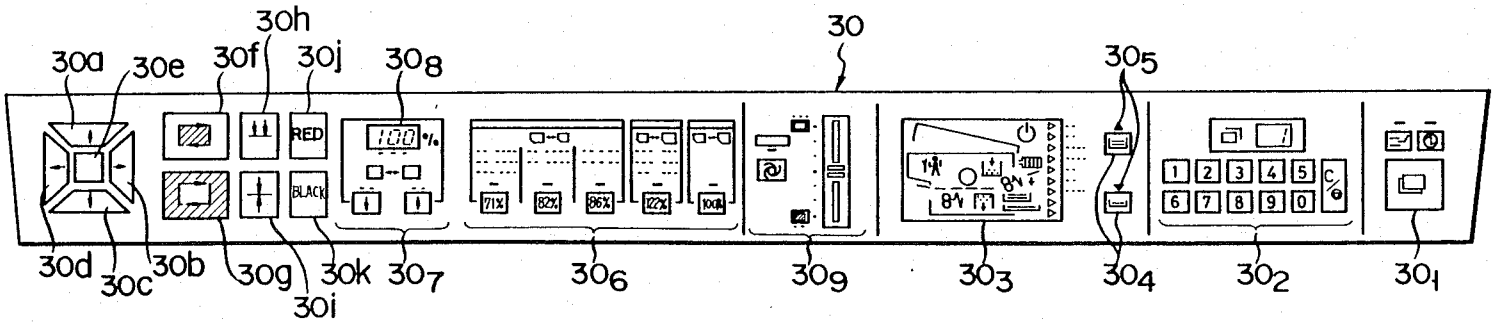

FIG. 5 shows a control panel 30 mounted on the housing 1. The control panel 30 carries thereon a copy key $30_1$ for starting the copying operation, ten-keys $30_2$ for setting the number of copies to be made and the like, a display section $30_3$ for indicating the operating conditions of the individual parts or paper jamming, cassette selection keys $30_4$ for alternatively selecting the upper, middle, or lower paper cassette $13_1$, $13_2$ or $13_3$, and cassette display sections $30_5$ for indicating the selected cassette. The control panel 30 is further provided with ratio setting keys $30_6$ for setting the enlargement or reduction ratio of copy selected among several predetermined ratios, zoom keys $30_7$ for adjustably setting the enlargement or reduction ratio, a display section $30_8$ for displaying the set ratio, and a density setting section $30_9$ for setting the copy density.

Additionally arranged on the control panel 30 are operation keys 30*a*, 30*b*, 30*c* and 30*d* for shifting a spot light source (mentioned later) which serves to indicate erasure positions on the original, a position designating key 30*e* for inputting the coordinate positions indicated by the spot light source, and erasure range designating keys 30*f* and 30*g* for designating the erasure ranges in the designated positions. Furthermore, the control panel 30 carries thereon a multicolor copying designating key 30*h*, a duplex copying designating key 30*i*, a red designating key 30*j* for designating the developing unit $12_1$ which stores a red toner by way of an example, and a black designating key 30*k* for designating the developing unit $12_2$ which stores a black toner by way of an example. When the power is turned on without operating either of the copying mode designating keys 30*h* and 30*i*, the copying machine housing 1 is automatically set so as to perform the regular one-side copying operation.

Figure 6:
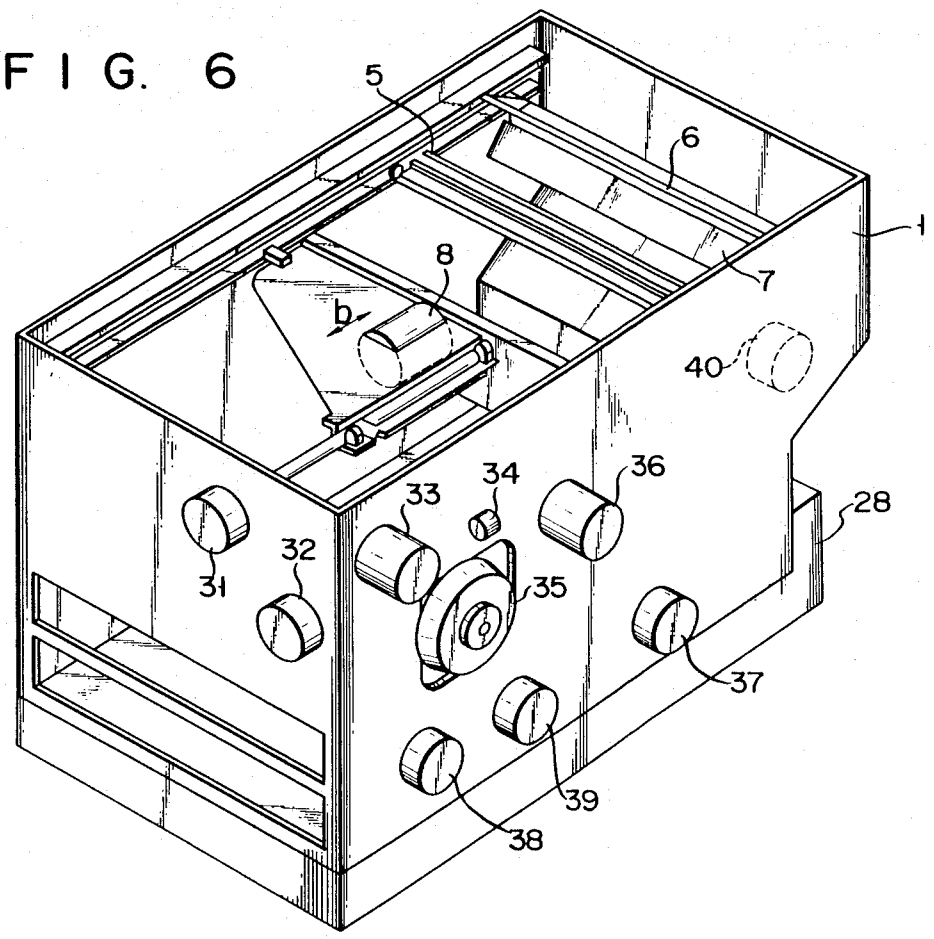

FIG. 6 shows a specific arrangement of drive sources for individual drive sections of the copying machine constructed in the aforesaid manner. The drive sources include the following motors. Numeral 31 designates a motor for lens drive. The lens drive motor 31 serves to shift the position of the lens block 8 for magnification or reduction. Numeral 32 designates a motor for mirror drive. The mirror drive motor 32 serves to change the distance (optical path length) between the mirror 5 and the mirrors 6 and 7 for magnification or reduction. Numeral 33 designates a motor for scanning. The scanning motor 33 serves to move the exposure lamp 4 and the motors 5, 6 and 7 for scanning the original. Numeral 34 designates a motor for shutter drive. The shutter drive motor 34 serves to move a shutter (not shown) for adjusting the width of charging of the photosensitive drum 10 by the charger 11 at the time of magnification or reduction.

Numeral 35 designates a motor used for developing. The developing motor 35 serves to drive the developing roller and the like of the developing unit 12. Numeral 36 designates a motor used to drive the drum. The drum drive motor 36 serves to drive the photosensitive drum 10. Numeral 37 designates a motor for fixation. The fixing motor 37 serves to drive the sheet conveyor belt 22, the fixing roller pair 23, and the exit roller pair 24. Numeral 38 designates a motor for paper supply. The paper supply motor 38 serves to drive the papersupply rollers 15 and 16. Numeral 39 designates a motor for feeding sheets. The sheet feed motor 39 serves to drive the aligning roller pair 19. Numeral 40 designates a motor for fan drive. The fan drive motor 40 serves to drive the cooling fan 29.

Figure 7:
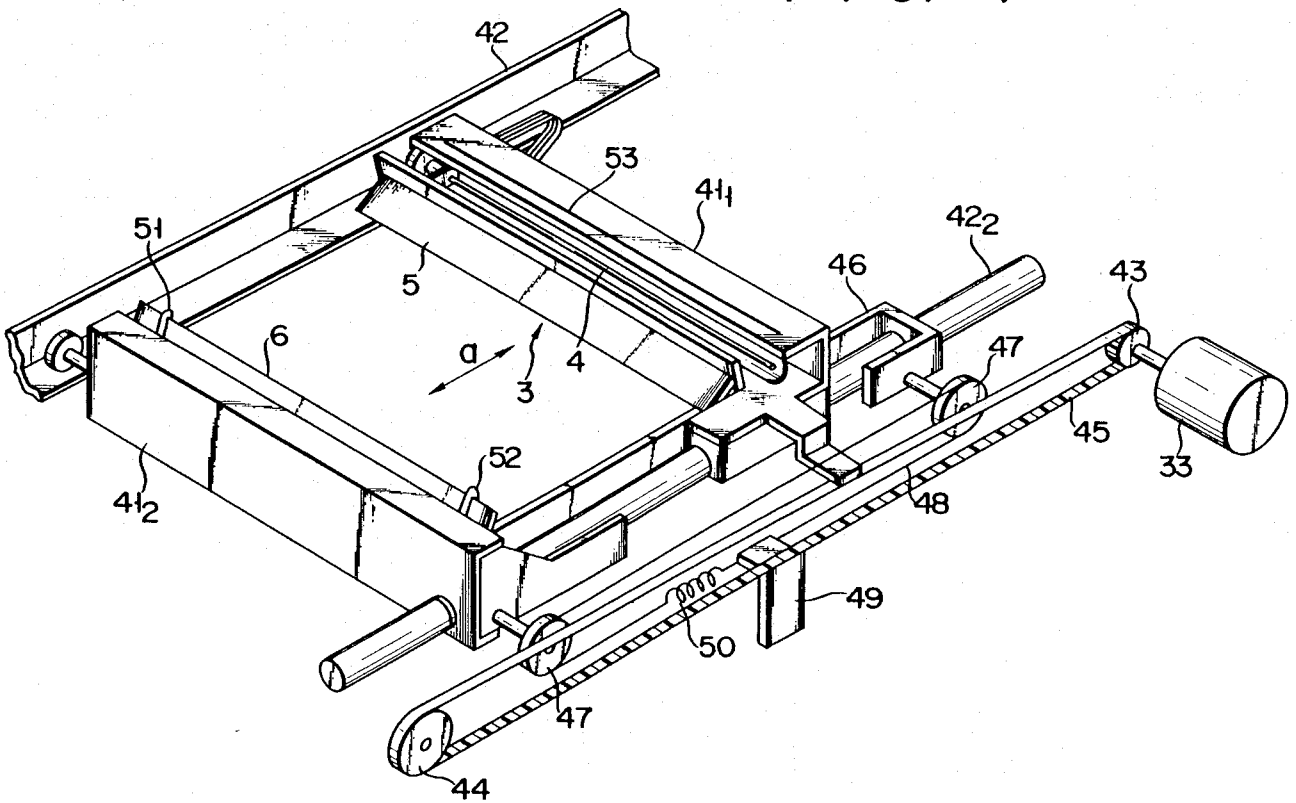

FIG. 7 shows a drive mechanism for reciprocating the optical system 3. The mirror 5 and the exposure lamp 4 are supported by a first carriage $41_1$, and the mirrors 6 and 7 by a second carriage $41_2$. These carriages $41_1$ and $41_2$ can move parallel in the direction indicated by arrow a, guided by guide rails $42_1$ and $42_2$. The four-phase pulse motor 33 drives a pulley 43. An endless belt 45 is stretched between the pulley 43 and an idle pulley 44, and one end of the first carriage $41_1$ supporting the mirror 5 is fixed to the middle portion of the belt 45.

On the other hand, two pulleys 47 are rotatably attached to a guide portion 46 (for the rail $42_2$) of the second carriage $41_2$ supporting the mirrors 6 and 7, spaced in the axial direction of the rail $42_2$. A wire 48 is stretched between the two pulleys 47. One end of the wire 48 is connected directly to a fixed portion 49, while the other end is connected thereto by means of a coil spring 50. The one end of the first carriage $41_1$ is fixed to the middle portion of the wire 48.

With this arrangement, when the pulse motor 33 is driven, the belt 45 turns around to move the first carriage $41_1$. As the first carriage $41_1$ travels, the second carriage $41_2$ also travels. Since the pulleys 47 then serve as movable pulleys, the second carriage $41_2$ travels in the same direction as and at a speed half that of the first carriage $41_1$. The traveling direction of the first and second carriages $41_1$ and $41_2$ is controlled by changing the rotating direction of the pulse motor 33.

The original table 2 carries thereon an indication of a reproducible range corresponding to the size of designated paper sheets. If the sheet size designated by the sheet selection keys $30_4$ and the copy ratio specified by the ratio setting keys $30_6$ or $30_7$ are (Px, Py) and K, respectively, the reproducible range (x, y) is given by $$x = Px/K,$$

$$y = Py/K.$$

Out of the coordinates (x, y) designating any point within the reproducible range, as shown in FIG. 1, the x coordinate is indicated by indexes 51 and 52 arranged on the inside of the original table 2, and the y coordinate by a scale 53 provided on the top face portion of the first carriage $41_1$.

Figure 8:
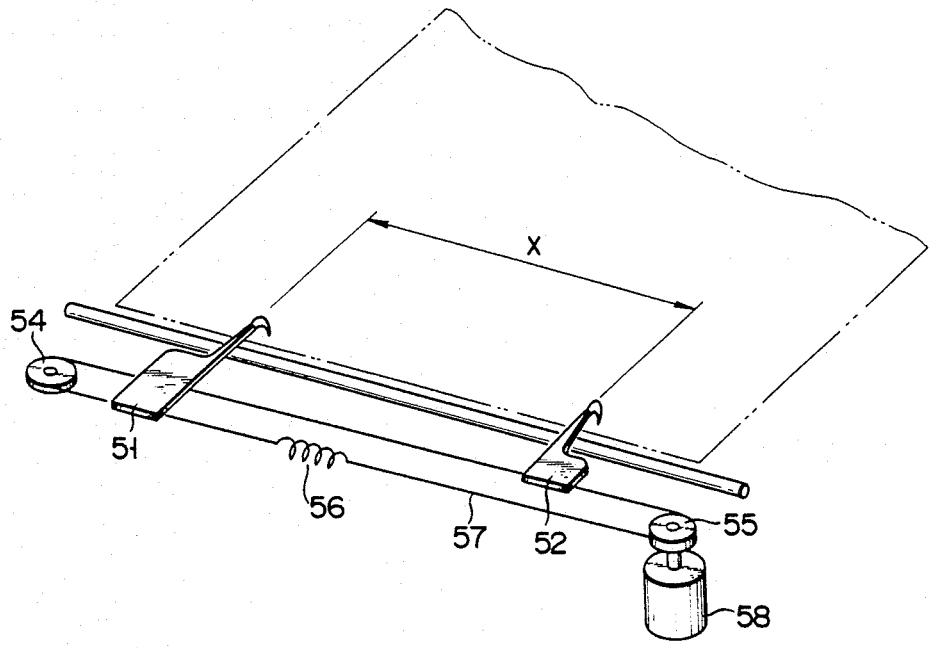

As shown in FIG. 8, the indexes 51 and 52 are attached to a wire 57 which is stretched between pulleys 54 and 55 through the aid of a spring 56. The pulley 55 is rotated by a motor 58. The distance between the indexes 51 and 52 can be changed by driving the motor 58 in accordance with the sheet size and the enlargement or reduction ratio.

The first carriage 41 moves to a predetermined position (home position depending on the enlargement or reduction ratio) as the motor 33 is driven in accordance with the sheet size and the ratio. When the copy key $30_1$ is depressed, the first carriage $41_1$ is first moved toward the second carriage $41_2$. The, the lamp 4 is lighted and the first carriage $41_1$ is moved away from the second carriage $41_2$. When the original scanning ends, the lamp 4 is turned off, and the first carriage $41_1$ is returned to the home position.

Figure 9:
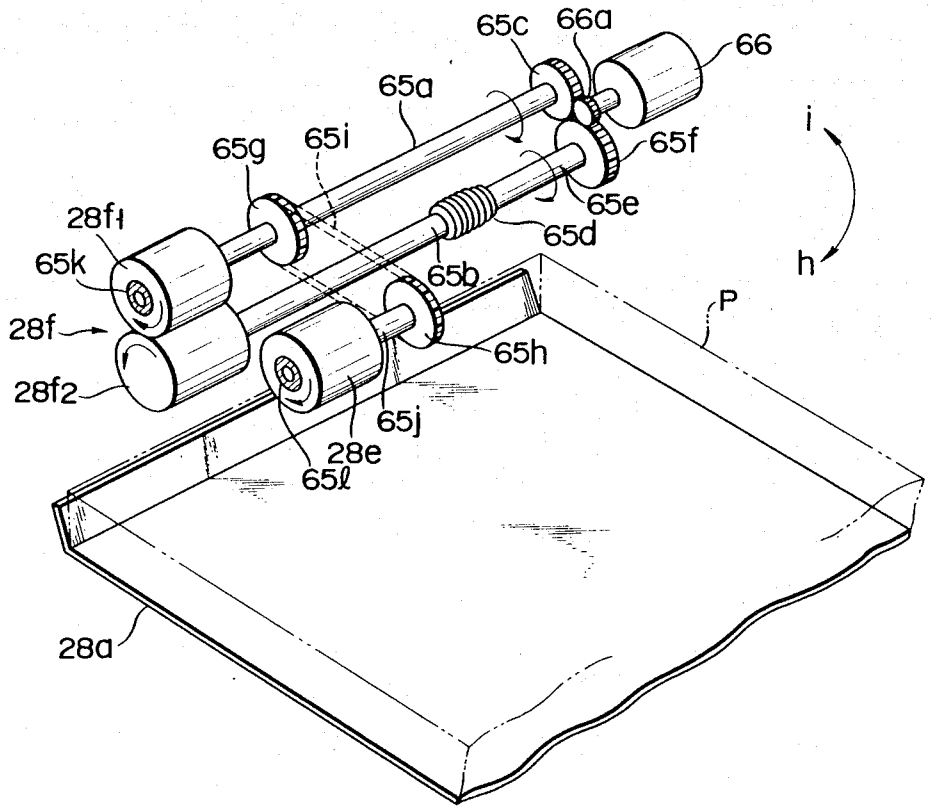

FIG. 9 shows an arrangement including the delivery roller 28*e* for taking out the paper sheets P collected in the collecting section 28*a* and the separating roller pair 28*f*. Rollers $28f_1$ and $28f_2$ constituting the separating roller pair 28*f* are mounted on one end portion of shafts 65*a* and 65*b*, respectively. A gear 65*c* is attached to the other end portion of the shaft 65*a*. The gear 65*c* is in mesh with a gear 66*a* which is attached to a motor 66.

The other end portion of the shaft 65*b* is coupled to one end portion of a shaft 65*e* by means of a spring clutch 65*d*. A gear 65*f* is mounted on the other end portion of the shaft 65*e*. The gear 65*f* is in mesh with the gear 66*a*. Further, a gear 65*g* is attached to the middle portion of the shaft 65*a*, and a chain 65*i* is stretched between the gear 65*g* and a gear 65*h* which is attached to the delivery roller 28*e*. The delivery roller 28*e* is driven in the directions indicated by arrows h and i in FIG. 9 by a drive mechanism (not shown).

One-way clutches 65*k* and 65*l* are provided between the roller $28f_1$ and the shaft 65*a* and between the delivery roller 28*e* and a shaft 65*j* respectively. The one-way clutches 65*k* and 65*l* are adapted to transmit power only when the shafts 65*a* and 65*j*, rotate in the direction indicated by the arrows. The frictional force of the spring clutch 65*d* is set so that the shafts 65*b* and 65*e* slip when the force at the point of contact between the rollers 28$f_1$ and 28$f_2$ exceeds a value V1. The frictional force T2 between the rollers 28$f_1$ and 28$f_2$ is greater than the frictional force T1 of the spring clutch 65*d*. Normally, therefore, the roller 28$f_2$ rotates against the rotatory force of the motor 66, associated with the roller 28$f_1$.

Meanwhile, the frictional force Tf between each two adjacent paper sheets P is smaller than the frictional force TR between each paper sheet P and the rollers 28*e*, 28$f_1$ and 28$f_2$. The relationships between these frictional forces Tf and TR and the frictional force T1 of the spring clutch 65*d* are given by TR>T1>Tf.

Figure 10A:
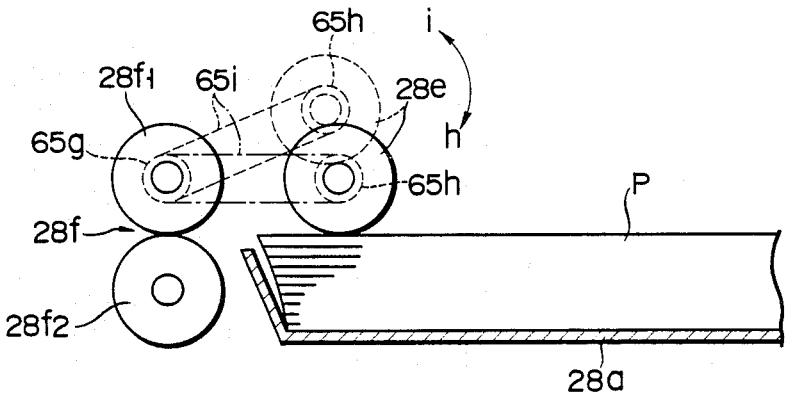
FIGS. 10A, 10B, 10C and 10D are side views of an essential part for illustrating the operation of the rollers shown in FIG. 9.
Figure 10B:
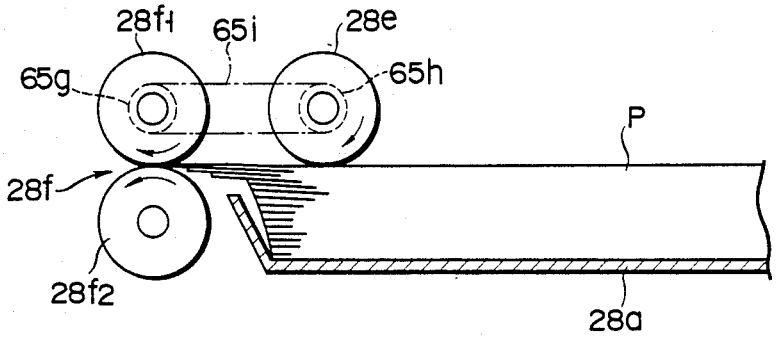
Figure 10C:
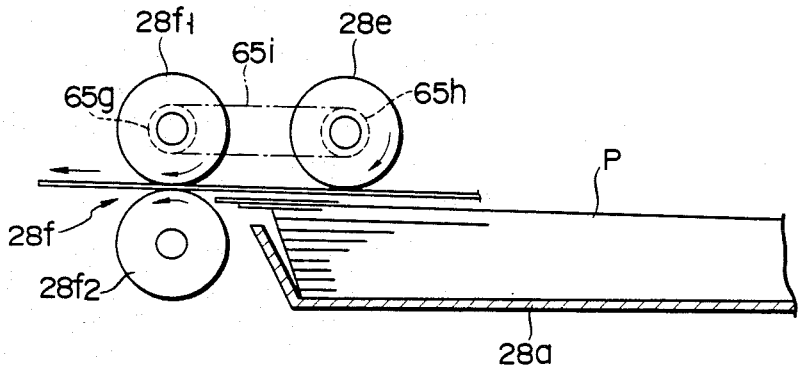
Figure 10D:
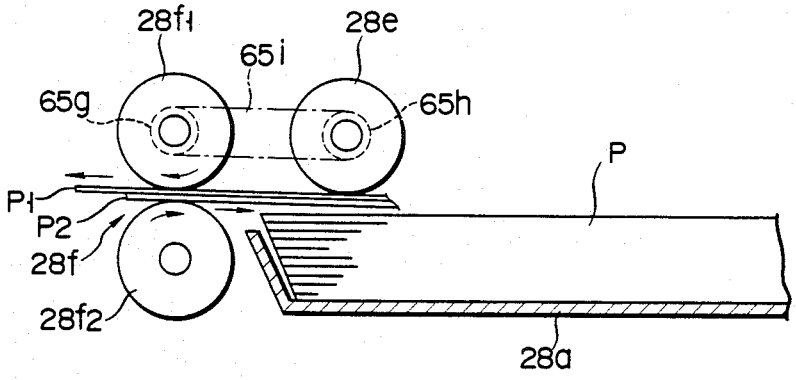

The operation of the above-mentioned arrangement will now be described. When the copy key 30$_1$ is depressed again after copied paper sheets P are collected in the collecting section 28*a*, the delivery roller 28*e* is lowered in the direction indicated by arrow h by the dotted line in FIG. 10A. When the roller 28*e* comes into contact with the pile of paper sheets P, as shown in FIG. 10B, the motor 66 is rotated, and the rollers 28$f_1$, 28$f_2$ and 28*e* are rotated in their respective directions indicated by the arrows. As a result, the paper sheets P are taken out from the collecting section 28*a* by the delivery roller 28*e*, and then delivered by the rollers 28$f_1$ and 28$f_2$, as shown in FIG. 10C. If two paper sheets P1 and P2 are simultaneously taken out from the collecting section 28*a* to be fed between the rollers 28$f_1$ and 28$f_2$, as shown in FIG. 10D, the sheet P1 in contact with the roller 28$f_1$ is advanced in the direction indicated by the arrow, on account of the aforesaid relationships between the frictional forces. On the other hand, the paper sheet P2 in contact with the roller 28$f_2$ is returned to the collecting section 28*a*, since the roller 28$f_2$ is rotated in the same direction as the roller 28$f_1$, urged by the driving force of the motor 66. Thus, the paper sheets P are bound to be taken out one by one from the collecting section 28*a*.

Figure 11:
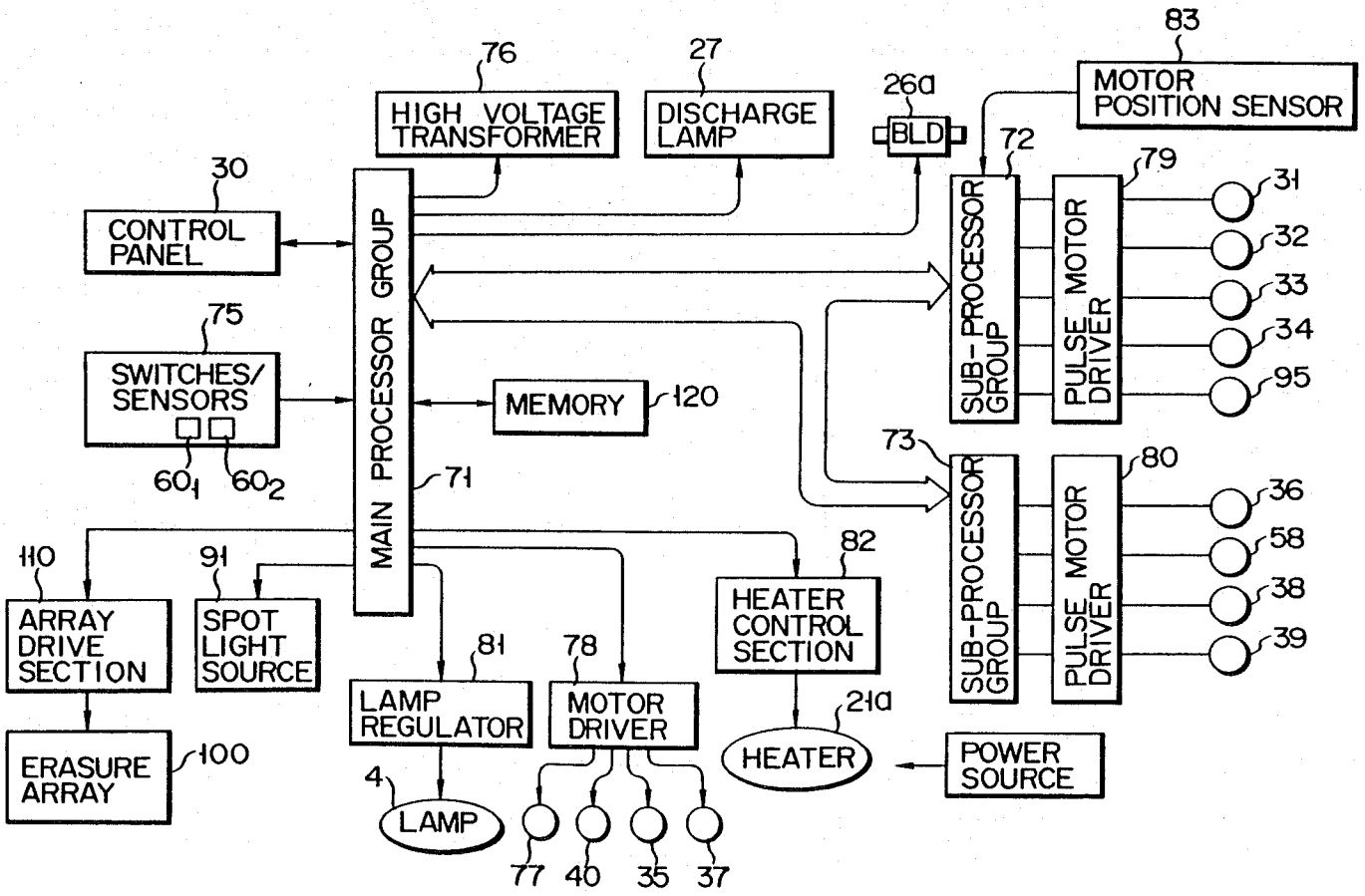

FIG. 11 shows a general control circuit of the electronic copying machine. This control circuit is mainly composed of a main processor group 71 and first and second sub-processor groups 72 and 73. The main processor group 71 detects input data from the control panel 30 and a group of input devices 75 including various switches and sensors, such as the cassette size detection switches 60$_1$ and 60$_2$, and controls a high-voltage transformer 76 for driving the chargers, the discharge lamp 27, a blade solenoid 26*a* of the cleaner 26, a heater 21*a* of the fixing roller pair 21, the exposure lamp 4, and the motors 31 to 40, 58, 66 and 77, thus accomplishing the copying operation. The main processor group 71 also controls a spot light source 91, a pulse motor 95, an erasure array 100, an array drive section 110, and a memory 120, thereby erasing any unnecessary portions of the original. These components 91, 95, 100, 110 and 120 will be described in detail later.

The motors 35, 37 and 40 and a toner-supply motor 77 for supplying the toner to the developing unit 12 are connected through a motor driver 78 to the main processor group 71 to be controlled thereby. The motors 31 to 34 and 95 are connected through a pulse motor driver 79 to the first subprocessor group 72 to be controlled thereby. The motors 36, 38, 39, 58 and 66 are connected through a pulse motor driver 80 to the second subprocessor group 73 to be controlled thereby.

Further, the exposure lamp 4 is controlled by the main processor group 71 through a lamp regulator 81, and the heater 21*a* by the main processor group 71 through a heater control Section 82. The main processor group 71 gives instructions for the start or stop of the individual motors to the first and second sub-processor groups 72 and 73. Thereupon, the first and second subprocessor groups 72 and 73 feed the main processor group 17 with status signals indicative of the operation mode of the motors. Also, the first sub-processor group 72 is supplied with positional information from a position sensor 83 for detecting the respective initial positions of the motors 31 to 34.

The spot light source 91 will now be described in detail.

Figure 13:
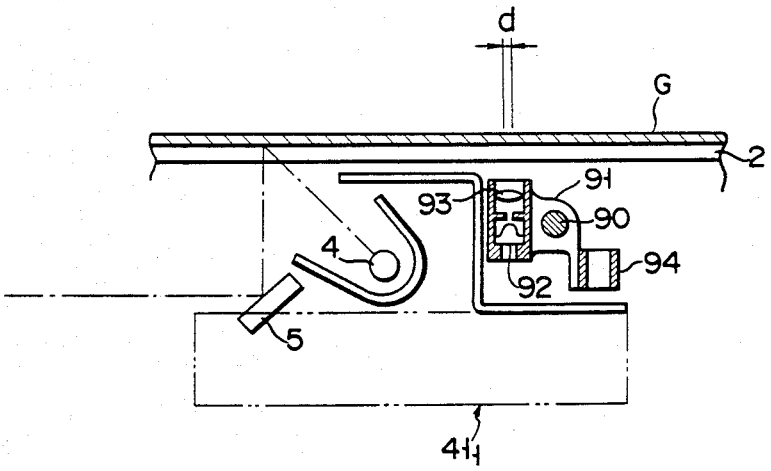
Figure 12:
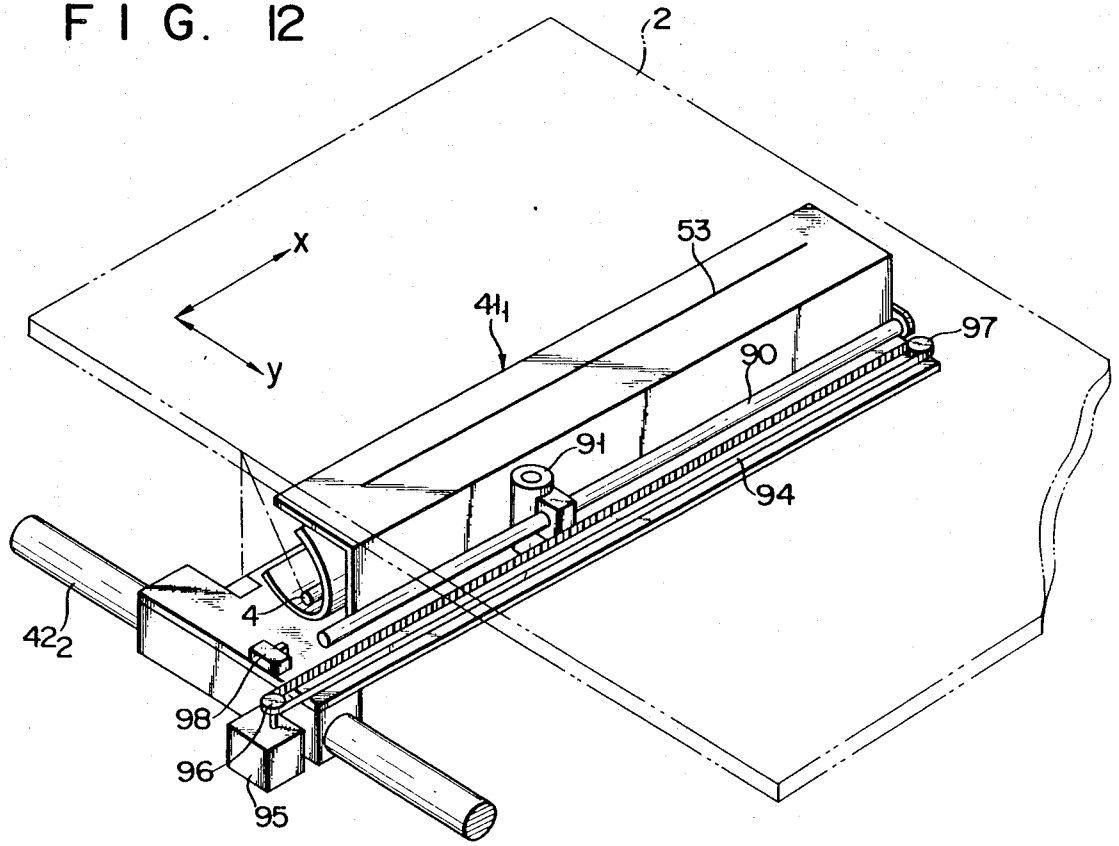

In FIGS. 12 and 13, a guide shaft 90 is disposed at that portion of the first carriage 41$_1$ intercepting the light from the lamp 4, extending along the lamp 4. The guide shaft 90 is movably fitted with the spot light source 91 as the indicating means for indicating an erasure range of the original. As shown in FIG. 13, the spot light source 91 includes a light emitting element 92, such as a light emitting diode or lamp, and a lens 93 which are opposed to the original table 2.

A light beam emitted from the light emitting element 92 is applied to the original table 2 through the lens 93, as a spot light with a diameter d of, e.g., 2 mm. The spot light has enough brightness to be transmitted through an original G as thick as, e.g., a postcard set on the original table 2. The spot light source 91 is coupled to a timing belt (toothed belt) 94 extending along the guide shaft 90. The timing belt 94 is stretched between a pulley 96 mounted on the shaft of the pulse motor 95 and a driven pulley 97. As the pulse motor 95 is rotated the spot light source 91 is moved in a direction perpendicular to the scanning direction of the first carriage 41$_1$.

A position sensor 98 formed of a microswitch for detecting the initial position of the spot light source 91 is attached to that portion of the first carriage 41$_1$ which is located beside the end portion of the guide shaft 90 on the side of the pulse motor 95. When the spot light source 91 is moved, for example, it first abuts against the position sensor 98 to have its initial position detected thereby.

Figure 14:
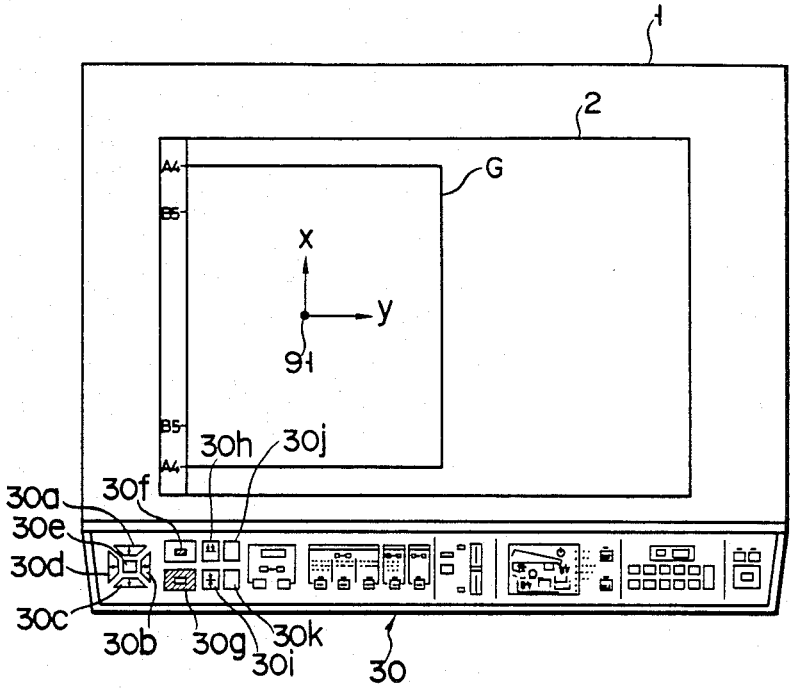
Figure 15:
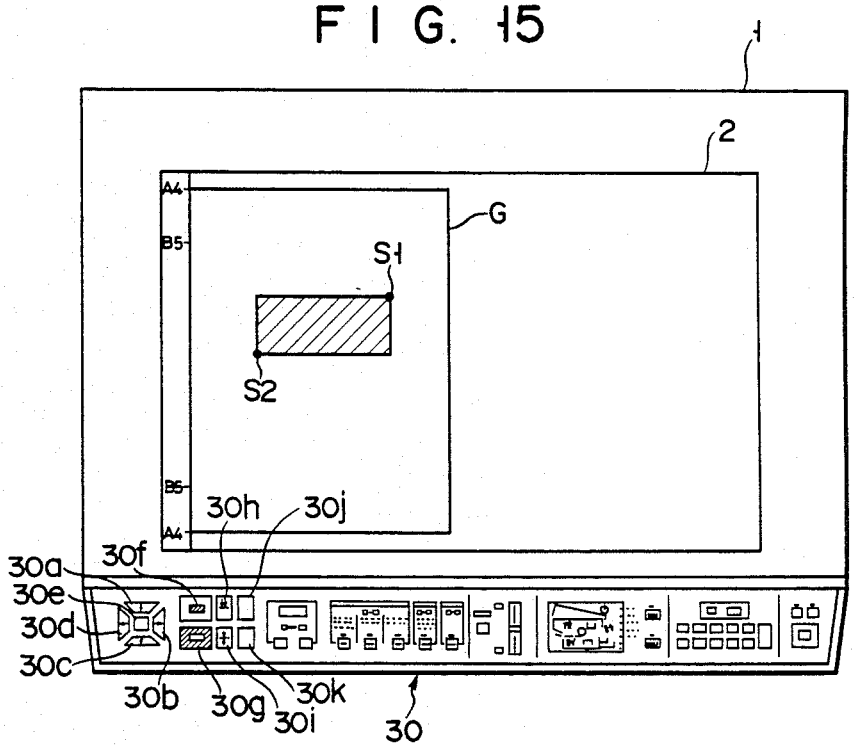
Figure 16:
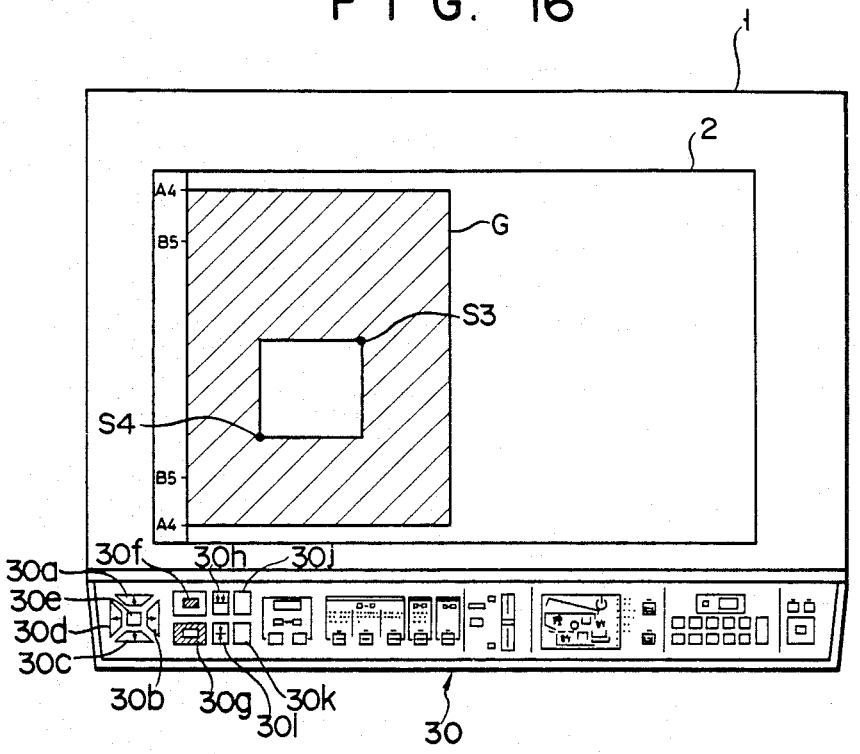

Referring now to FIGS. 14 to 16, there will be described a method for designating the erasure range of the original by means of the spot light source 91.

The spot light source 91 is moved by operating the operation keys 30*a* to 30*d*. When the operation keys 30*b* and 30*d* are depressed, the motor 33 is started, and the first carriage 41$_1$ and the spot light source 91 are moved in the scanning direction (indicated by arrow y in FIG. 14). When the operation keys 30*a* and 30*c* are depressed, on the other hand, the motor 95 is started, and the spot light source 91 is moved in a direction (indicated by arrow x in FIG. 14) perpendicular to the scanning direction.

Observing the spot light transmitted through the original G, the operator operates the operation keys 30*a* to 30*d*. When the spot light reaches, for example, a spot S1 on the original G shown in FIG. 15, the operator depresses the position designating key 30*e*. Thereupon, the coordinate position indicated by the spot S1 is stored in the main processor group 71 shown in FIG. 11. Likewise, if the position designating key 30*e* is depressed when a spot S2 on the original G is reached by the spot light, the position of the spot S2 is stored in the main processor group 71. This position of the spot light can be detected by, for example, counting drive pulses delivered from the pulse motors 33 and 95. When the erasure range designating key 30*f* is depressed thereafter, a rectangular region (hatched region) having its two opposite vertexes on the spots S1 and S2 is designated as the erasure range, as shown in FIG. 15.

Figure 17A:
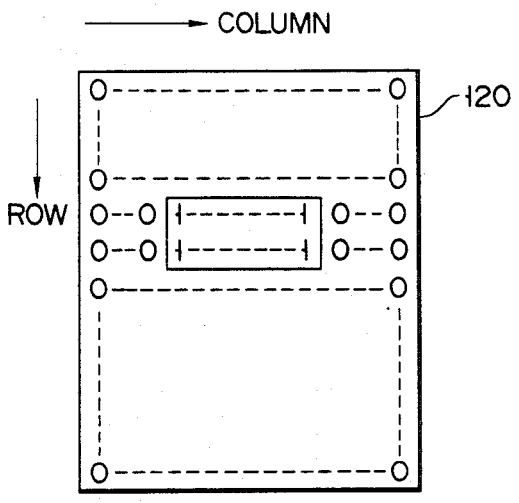
FIGS. 17A and 17B are diagrams for illustrating a memory.
Figure 17B:
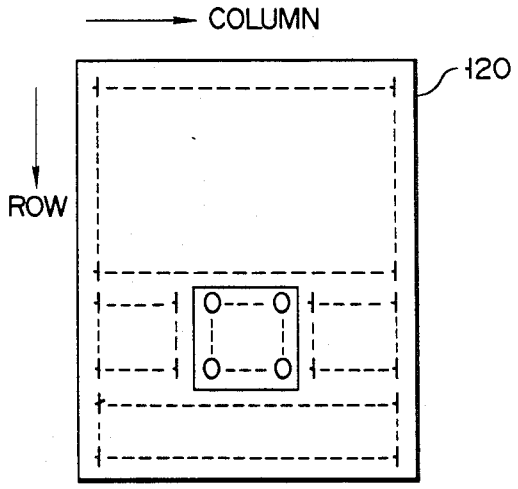

If the erasure range designating key 30*g* is depressed after designating spots S3 and S4 on the original G, the other region of the original G (i.e. not a square region having its two opposite vertexes on the spots S3 and S4) is designated as the erasure range. Thus, if the erasure range designating key 30*f* or 30*g* is depressed, the main processor group 71 executes calculation in accordance with the positions of the two designated spots, and high- and low-level signals "1" and "0" are stored in those addresses of the memory 120 for the erasure range and the remaining region, respectively, as shown in FIGS. 17A and 17B for the manners of designation shown in FIGS. 15 and 16, respectively.

For example, the memory 120 is formed of a RAM whose capacity in the direction of each column is substantially equal to a value obtained by dividing the moved distance of the spot light source 91 in the x direction by the positional resolution in the x direction, and whose capacity in the direction of each row is substantially equal to a value obtained by dividing the moved distance of the spot light source 91 in the y direction by the positional resolution in the y direction. In the case of FIG. 11, high- and low-level signals are stored in those addresses of the memory 120 for the hatched region and the other region, respectively, based on data supplied from the main processor group 71.

Figure 19:
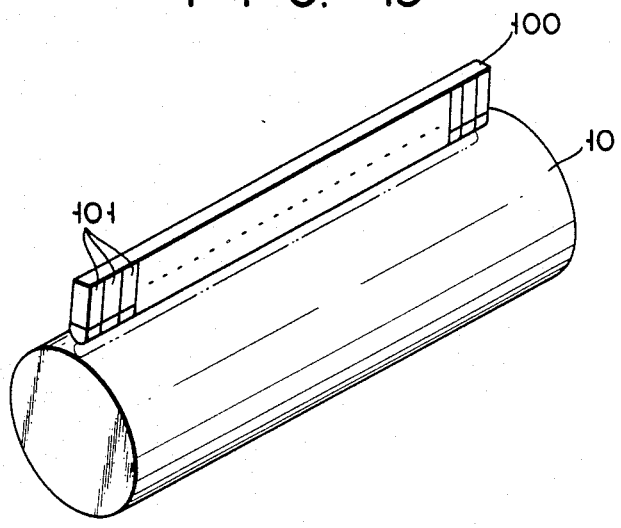
Figure 18:
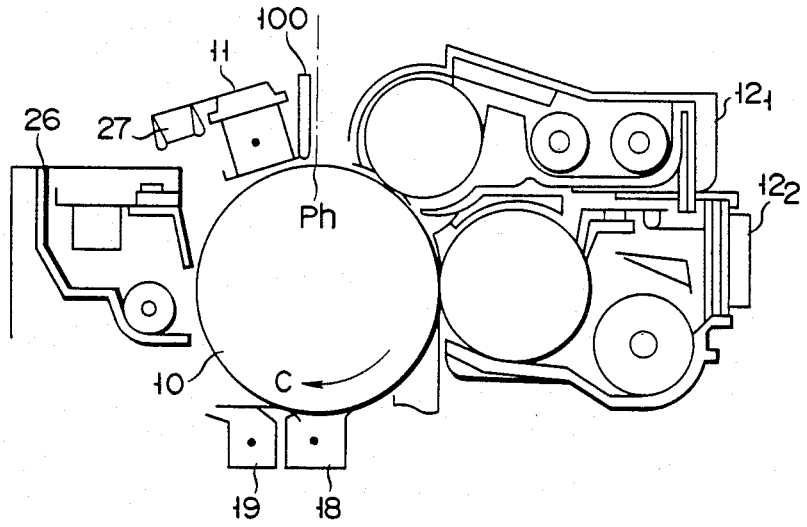
Figure 20:
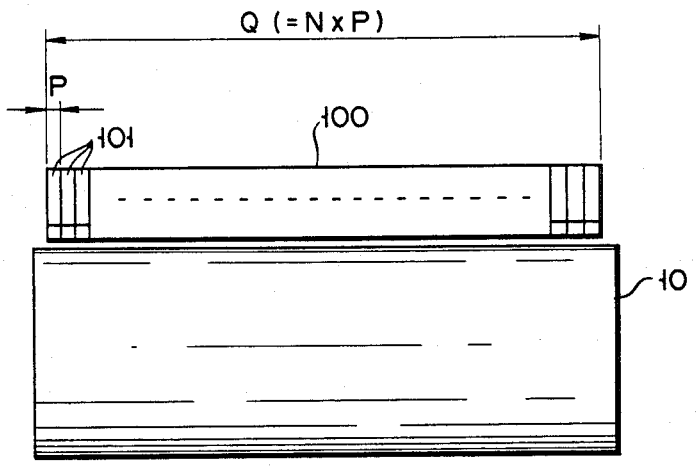
Figure 21A:
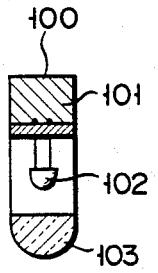
FIG. 21A is a side sectional view of the erasure array.
Figure 21B:
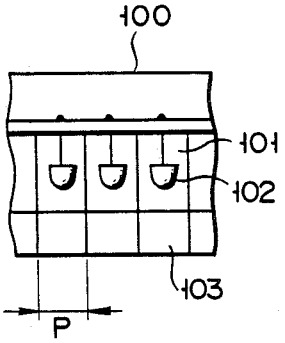
FIG. 21B is a partial front view of the erasure array.
Figure 22:
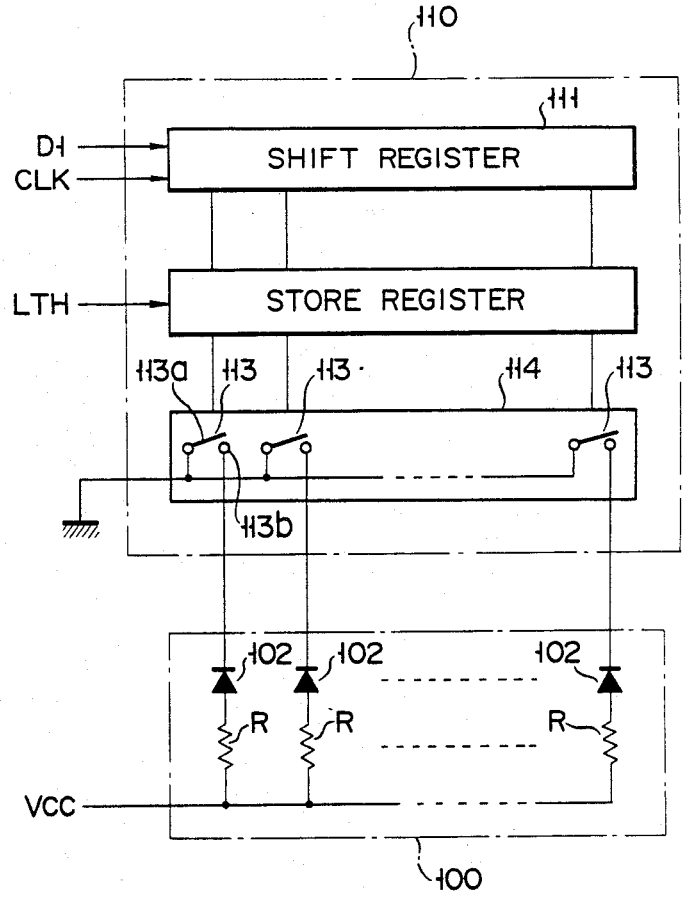

As shown in FIG. 18, on the other hand, the erasure array 100 as the erasing means is disposed close to the photosensitive drum 10, between the charger 11 and an exposure region Ph, for example. As shown in FIGS. 19 and 20, the erasure array 100 includes a plurality of shading cells 101 which are arranged in a direction perpendicular to the rotating direction of the photosensitive drum 10. As shown in FIGS. 21A and 21B, the cells 101 each contains therein a light emitting element 102 formed of, e.g., a light emitting diode. Moreover, a lens 103 for converging light from the light emitting element 102 on the surface of the photosensitive drum 10 is disposed at the opening portion of each cell 101 facing the photosensitive drum 10.

The number of light emitting elements 102 arranged in the erasure array 100 is equivalent to, for example, the column-direction capacity of the memory 120. If the distance between each two adjacent light emitting elements 102 and the number of light emitting elements 102 are P and N, respectively, the overall length Q of the erasure array 100 is $Q=N\times P$.

The erasure array 100 is driven by the array drive section 110. As shown in FIG. 17, the array drive section 110 includes a shift register 111 having the same number of bits as that in the column direction of the memory 120, a store register 112 for holding the contents of the shift register 111, and a switch circuit 114 consisting of a plurality of switch elements 113 adapted to be turned on or off in response to output signals from the store register 112. The respective movable contacts 113*a* of the switch elements 113 are grounded, while their fixed contacts 113*b* are connected to the respective cathodes of the light emitting elements 102 constituting the erasure array 100. The anodes of the light emitting elements 102 are connected to a power source $V_{CC}$ through current-limiting resistors R, individually.

When the original cover is laid and the copy key $30_1$ is depressed after the erasure range of the original is designated in the aforesaid manner, the first carriage $41_1$ and the photosensitive drum 10 are actuated, and data D1 for one column are successively read out in the row direction from the memory 120. The read data D1 are transferred to the shift register 111 of the array drive section 110 in response to clock signals CLK. When the charged portion of the surface of the photosensitive drum 10 reaches the erasure array 100 after the data for one column are transferred to the shift register 111, the main processor group 71 delivers a latch signal LTH. In response to the latch signal LTH, the data having so far been stored in the shift register 111 is stored in the store register 112. As mentioned before, the erasure array 100 is disposed between the charger 11 and the exposure region Ph. Therefore, if the angle between the erasure array 100 and the exposure region Ph and the angular velocity of the photosensitive drum 10 are $\theta 1$ and $\omega$, respectively, the output timing of the latch signal LTH is controlled so that data for one row delivered from the memory 120 are supplied to the store register 112 within a time equivalent to $\theta/\omega$.

The individual switch elements 113 of the switch circuit 114 are controlled by the output signals of the store register 112. If the output level of the store register 112 is high, the switch elements 113 are turned on; if low, then off. Thus, the light emitting elements 102 connected to the switch elements 113 are turned on and off when their corresponding switch elements 113 are turned on and off, respectively. Accordingly, those portions of the charged surface of the photosensitive drum 10 which correspond to the glowing light emitting elements 102 are de-electrified. Even though exposed thereafter, the de-electrified portions will never bear any electrostatic latent image thereon. Thus, the erasing of the original image is accomplished. Thereafter, the data in the memory 120 are read out column by column for image erasing.

Figure 23A:
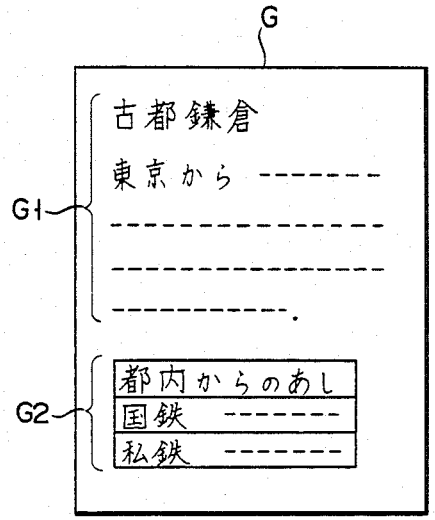
FIGS. 23A, 23B, 23C, 23D and 23E are diagrams for illustrating an example of the operation of the apparatus.
Figure 23B:
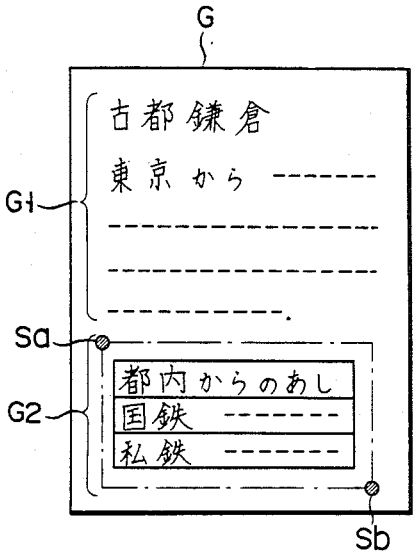
Figure 23C:
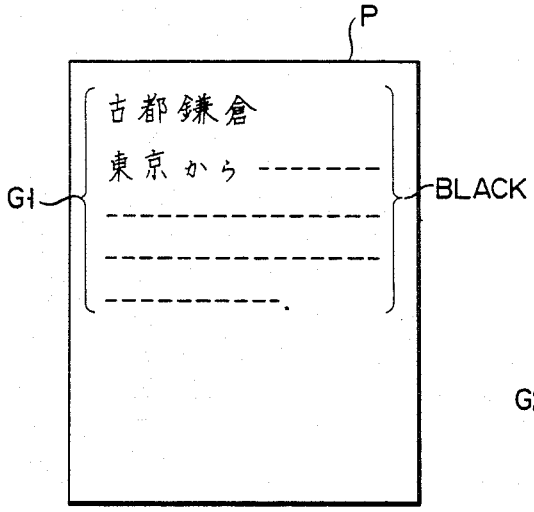

With the use of the apparatus constructed in this manner, a copy image consisting of, e.g., a black portion G1 and a red portion G2 may be obtained from a unicolor original G, as shown in FIG. 23A. In doing this, the original G is set on the original table 2, and the multicolor copying designating key 30*h* and a black designating key 30*k*, for example, are depressed first. Thereafter, the operation keys 30*a* to 30*d*, the position designating key 30*e*, and the erasure range designating key 30*f* are operated so that the red copy portion G2 is designated as an erasure range by coordinates (Sa, Sb), as shown in FIG. 23B. If the copy key $30_1$ is depressed in this state, only the portion G1 is formed on the paper sheet P with use of the black toner, as shown in FIG. 23C, and the paper sheet P is temporarily stored in the collecting section 28*a*.

Figure 23D:
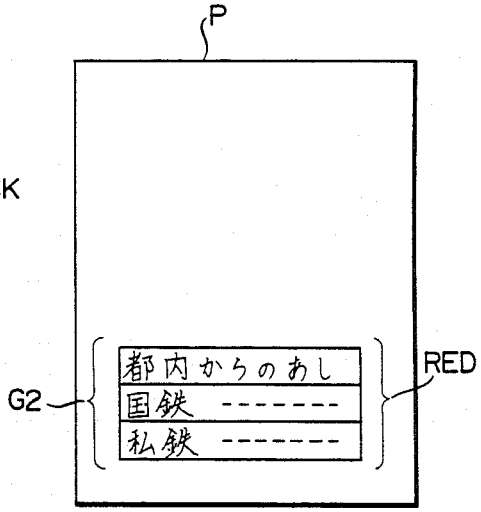
Figure 23E:
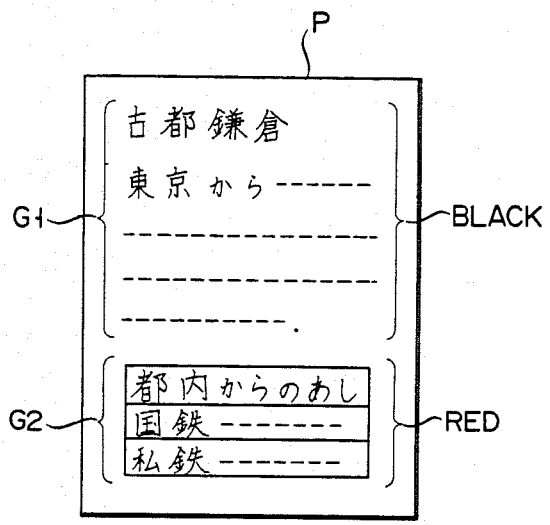

When the erasure range designating key 30*g* is then depressed, the black copy portion G1 (which corresponds to all portions of the paper sheet P other than the range defined by the coordinates (Sa, Sb)) is designated as an erasure range. In this state, if the red designating key 30*j* and the copy key $30_1$ are depressed in succession, the paper sheet P carrying only the portion G1 shown in FIG. 23C is taken out from the collecting section 28*a*. Then, only the portion G2 shown in FIG. 23D is formed on the paper sheet P with the use of the red toner. Thus, as shown in FIG. 23E, the original image is formed on the paper sheet P with the use of the black and red toners for the portions G1 and G2, respectively.

In the case described above, only one copy is made. In making a plurality of copies, only the black portion G1 of the image is first copied to a plurality of paper sheets, and the red portion G2 is then copied in a superposed manner.

The toner colors are not limited to red and black.

According to the embodiment described above, the apparatus has a duplex copying function, a function to selectively erase any undesired portions of the original image, and a multicolor copying function. Accordingly, a multicolor original may be copied to form a colorful, clear copy image in which the color of one portion is different from that of another.

Moreover, it is possible to designate the erasure range while observing the spot light on the original table 2, so that operation is easy and there will be no deviation between the designated erasure range and the range actually erased during the copying operation.

Since the spot light source 91 is mounted on the first carriage $\mathbf{41}_1$, furthermore, use of space is efficient enough to restrain the apparatus from becoming too bulky.

Figure 24:
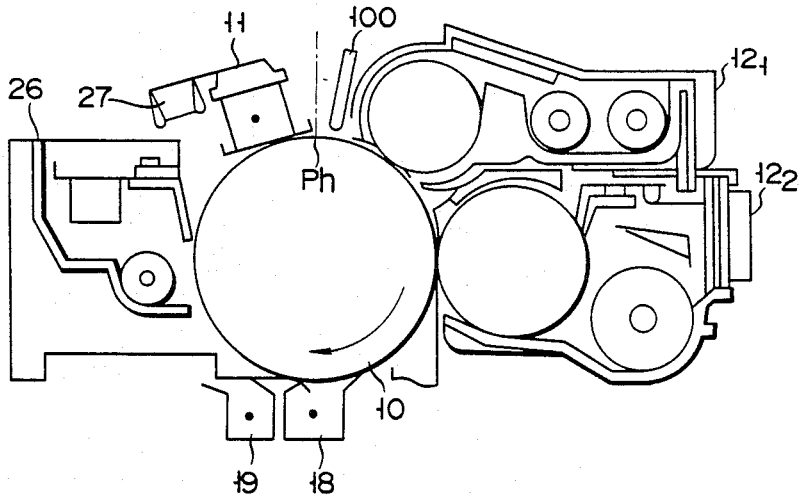

The present invention is not limited to the above embodiment. For example, instead of being disposed between the charger 11 and the exposure region Ph, as shown in FIG. 18, the erasure array 100 may be arranged between the exposure region Ph and the developing unit 12, as shown in FIG. 24, so that the formed electrostatic latent image is erased as specified.

Also, the capacity of the memory 120 may be changed as required.

It is to be understood that various changes and modifications may be effected in the present invention by one skilled in the art without departing from the scope or spirit of the invention.

According to the embodiment described above, moreover, the apparatus is provided with the two developing units $\mathbf{12}_1$ and $\mathbf{12}_2$ which individually use two developing agents of different colors for forming a two-color copy image. However, the present invention is not limited to such an arrangement, and the developing agents used in the first and second developing units $\mathbf{12}_1$ and $\mathbf{12}_2$ may be of the same color. In this case, the developing agent used in the first developing unit $\mathbf{12}_1$ may, for example, be selected for a sharp copy image, and the developing agent in the second developing unit $\mathbf{12}_2$ for a soft copy image. According to this modification of the embodiment, it is possible to selectively copy those portions of a single original image corresponding to characters or graphs with use of the first developing unit $\mathbf{12}_1$ and to selectively copy those portions requiring halftones, such as photographs, with use of the second developing unit $\mathbf{12}_2$, thereby forming a copy image improved in general quality.

In the modified example described above, the image quality is changed by varying the type of developing agent. Alternatively, however, the image quality may be selected by rotating the respective developing rollers of the two developing units $\mathbf{12}_1$ and $\mathbf{12}_2$ in different directions, i.e., with mode against mode, without changing the type of developing agent used.

In the embodiment described above, moreover, two developing processes are executed with use of two developing units. Alternatively, however, the image color or quality may be changed by replacing a singly provided developing unit with another, depending on the color or property of the developing agent to be used.

In the multicolor copying mode, according to the embodiment described above, a paper sheet having undergone a first copying cycle is automatically returned to the paper supply section by the duplex/multicolor copying unit 28. Alternatively, however, the paper cassettes $\mathbf{13}_1$, $\mathbf{13}_2$ and $\mathbf{13}_3$ may be given a manual sheet feed function. In this case, a paper sheet is simply discharged without using the duplex/multicolor copying unit 28 after it is subjected to the first copying cycle. The discharged paper sheet is manually fed again into the apparatus through the proper cassette $\mathbf{13}_1$, $\mathbf{13}_2$ and $\mathbf{13}_3$ for multicolor copying.

According to the present invention, as described in detail herein, there may be provided an image forming apparatus of very high utility value in which desired portions of an original image are designated and developed in one developing process, and portions other than the designated portions are developed in another developing process so that a copy image of a single original can be formed with use of different developing processes.

What is claimed is:

1. An image forming apparatus comprising:

a photosensitive body holding an electric charge on the surface thereof;

charging means for uniformly applying electric charge to the surface of the photosensitive body;

an original table adapted to carry an original thereon;

image exposure means for exposing the surface of the photosensitive body uniformly charged by the charging means to a light representing an image of the original on the original table, thereby forming an electric charge pattern responsive to the original image on the surface of the photosensitive body;

indicating means for indicating a specific range of the original on the original table, said indicating means including light emitting means for applying a spot light to the original on the original table from under the same, so that the perimeter of the specific range is defined by moving the spot light;

erasing means for erasing the electric charge on the portion of the surface of the photosensitive body other than that surface portion which corresponds to the specific range of the original indicated by the indicating means; and developing means adapted to alternatively supply developing agents of different types to the surface of the photosensitive body and to develop by means of the supplied developing agent that portion of the surface of the photosensitive body which corresponds to the specific range of the original indicated by the indicating means.

2. The image forming apparatus according to claim 1, wherein said indicating means includes first setting means for setting the specific range inside the perimeter and second setting means for setting the specific range outside the perimeter.

3. The image forming apparatus according to claim 1, wherein said developing means includes a first developing unit for supplying a first developing agent to the surface of the photosensitive body and a second developing unit for supplying a second developing agent to the surface of the photosensitive body.

4. The image forming apparatus according to claim 3, wherein said first developing agent includes a toner of a first color, and said second developing agent includes a toner of a second color different from the first color.

5. The image forming apparatus according to claim 4, wherein said first and second colors are black and red, respectively.